US007455270B2

(12) United States Patent
Maloney et al.

(10) Patent No.: US 7,455,270 B2
(45) Date of Patent: Nov. 25, 2008

(54) SUPPORT ARM MECHANISM

(75) Inventors: Eric W. Maloney, Jamestown, NY (US); Donald R. Pangborn, Jamestown, NY (US)

(73) Assignee: Weber Knapp Company, Jamestown, NY (US)

( * ) Notice: Subject to any disclaimer, the term of this patent is extended or adjusted under 35 U.S.C. 154(b) by 190 days.

(21) Appl. No.: 11/299,534

(22) Filed: Dec. 12, 2005

(65) Prior Publication Data

US 2007/0131833 A1 Jun. 14, 2007

(51) Int. Cl.
*E04G 3/00* (2006.01)

(52) U.S. Cl. ..... 248/278.1; 248/284.1; 248/286.1; 248/281.11; 248/918; 108/93

(58) Field of Classification Search ..... 248/278.1, 248/284.1, 286.1, 276.1, 918; 108/141, 93
See application file for complete search history.

(56) References Cited

U.S. PATENT DOCUMENTS 4,616,798 A 10/1986 Smeenge et al.
4,625,657 A * 12/1986 Little et al. ..... 108/93
5,836,560 A 11/1998 Kaplan et al.
5,924,664 A 7/1999 Mileos et al.
5,924,666 A * 7/1999 Liu ..... 248/286.1
6,116,557 A * 9/2000 Choy et al. ..... 248/286.1
6,176,456 B1 * 1/2001 Wisniewski ..... 248/281.11
6,186,460 B1 * 2/2001 Lin ..... 248/284.1
6,199,809 B1 * 3/2001 Hung ..... 248/284.1
6,270,047 B1 * 8/2001 Hudson ..... 248/286.1
6,273,382 B1 * 8/2001 Pemberton ..... 248/286.1
6,322,031 B1 11/2001 LeClair et al.
6,397,763 B1 6/2002 Panzarella et al.
6,409,127 B1 6/2002 VanderHeide et al.
6,488,248 B1 * 12/2002 Watt et al. ..... 248/279.1
6,533,229 B1 * 3/2003 Hung ..... 248/286.1
6,565,056 B2 * 5/2003 Lin ..... 248/284.1
6,905,102 B2 * 6/2005 Lin ..... 248/285.1
6,929,228 B2 * 8/2005 Whitaker et al. ..... 248/284.1
7,188,813 B2 * 3/2007 Kollar ..... 248/279.1
7,198,239 B2 * 4/2007 Mileos et al. ..... 248/281.11

OTHER PUBLICATIONS

"ISE—Dial-A-Posture", http://www.ise-ergonomics.com/products/product-display.cfm?CategoryID=ArmPlatform&GroupID=LeaderSeries&SubGroupID=LeaderArm&SSubGroupID=LeaderDial, accessed on Mar. 8, 2006.

(Continued)

*Primary Examiner*—Anita M King
(74) *Attorney, Agent, or Firm*—Simpson & Simpson, PLLC

(57) ABSTRACT

A mechanism for mounting a support including a linkage, wherein the linkage has at least three bars, the mechanism is attached to a base by a mounting member, and the mounting member has a pair of slots wherein the linkage may slide and pivot relative to the mounting member. In another embodiment, the mechanism includes a height indicator whereby a height of the mechanism relative to a height indicating surface is displayed. In a further embodiment, the mechanism includes an angle indicator whereby an angle of the support relative to an angle indicating surface is displayed. In yet another embodiment, the mechanism permits adjustment of the angle of the support relative to the angle indicating surface.

31 Claims, 16 Drawing Sheets

OTHER PUBLICATIONS

"Polaris Arm", http://www.knapeandvogt.com/kv/Idea-at-work/Adjustable+Keyboard+Systems/Keyboard+Systems/Polaris+Arm.htm?NR Mode=Published, accessed on Mar. 8, 2006.

"Pinnacle 2 (TM). WorkRite Ergonomics", http://www.workriteergo.com/products/productmain.asp?FamID=79, accessed on Mar. 8, 2006.

"ParamountArm (R). WorkRite Ergonomics", http://www.workriteergo.com/products/productmain.asp?FamID=30, accessed on Mar. 8, 2006.

"Ergonomic Keyboard Tray / Articulating Keyboard Tray from Humanscale—keyboard tray,ergonomic keyboard tray, keyboard platform,articulating keyboard tray", http://www.humanscale.com/products/keyboard_systems.cfm?detail=build &subdetail=mechanism, accessed on Mar. 8, 2006.

"Ergonomics In The Office—Humanscale Newroom : computer workstation ergonomics,ergonomic computer furniture, ergonomic office furniture,ergonomics in the office", http://www.humanscale.com/newsroom/pressDetail.cfm?press_id=32, accessed on Mar. 8, 2006.

* cited by examiner

SUPPORT ARM MECHANISM

FIELD OF THE INVENTION

The present invention relates generally to support arms, more particularly, to a support arm for an article, and, more specifically, to a durable, high strength support arm for an article having a reduced storage size and ergonomic factor indicators.

BACKGROUND

Over time, desk and office furniture designs have changed with the advent and acceptance of new technologies. For example, with the introduction of the typewriter, desks designed for writing became inadequate. Typewriters did not require that the work surface be as large, nor the height of the work surface be as high. Similarly, as personal computers began overtaking the work environment, keyboards and monitors presented new issues to accommodate. As in the past, design advancements continue, resulting most recently in flat screen monitors and wireless devices, e.g., keyboard and mouse.

Cost conscious businesses are always seeking ways to minimize expenses, for example, high efficiency lighting and heating, or even conserving office space. Thus, as desk space requirements decrease, an obvious next step for office designers is to reduce the size of desks. Older style cathode ray tube (CRT) monitors required a large area of unusable space in order to be positioned for comfortable viewing. Often this required placing the CRT monitor in a corner of a desk. Flat screen or liquid crystal diode (LCD) monitors do not share this same drawback. Office designers have been presented with the possibility of moving the monitors out of the corner and to a straight, smaller surface, thereby allowing them to increase the number of work stations within a given area.

Another common means by which office designers conserve desk space is by removing the keyboard from the desk and placing it below the desk top. Thus, providing a support mechanism to support a device, such as a keyboard, for movement relative to a base, such as a wall, desk top or table top, is well known in the art. Similarly, it is well known to utilize a locking device to releasably retain the device in a desired position.

For example, the keyboard support mechanism disclosed in commonly owned U.S. Pat. No. 6,176,456, hereby incorporated by reference, uses a three bar linkage mechanism for vertical swinging movement relative to a base in combination with a locking mechanism releasable for permitting vertical movement of the keyboard support upon the application of a lifting force thereto. Although the device taught in this patent elegantly provides the aforementioned movement and locking capabilities, the storage size is limited by the size of the mechanism and the length of the guide track upon which the mechanism travels.

Further issues presented to office designers include ergonomic considerations, specifically when faced with the situation where more than one person uses a workstation, i.e., flex and part-time employees. No two users are alike and therefore have different seated heights, arm lengths, etc . . . . To minimize potential problems such as carpal tunnel syndrome, consistent placement, i.e., height and angle, of the keyboard is critical. Thus, a support arm mechanism having means to display support height and angle would provide a person with the information needed to maintain the best alignment of the mechanism for that person's needs. Each person using the workstation may quickly and easily modify the support arm configuration, restoring their configuration, even if the support is moved to a different position. However, heretofore, no support arm mechanisms have provided height and angle information, as described above.

As can be derived from the variety of devices and methods directed at support arm mechanisms, many means have been contemplated to accomplish the desired end, i.e., rigid support of an article, without sacrificing the flexibility and small storage size afforded by a retractable linkage mechanism. Heretofore, tradeoffs between functionality and storage size were required. Additionally, ergonomic factors have driven support arm mechanism design, but positive feedback of support height and angle has not been considered. Thus, there has been a longfelt need for a support arm having high strength and a small storage size, with positive feedback of support height and angle.

BRIEF SUMMARY OF THE INVENTION

The present invention broadly includes a support arm mechanism having a three bar linkage and a mounting plate including a pair of parallel slots, wherein the three bar linkage is rotatably and translationally secured to the mounting plate. In one embodiment, the support arm mechanism includes a height indicator operatively arranged to display the height of the support arm mechanism relative to a height indicating surface. In another embodiment, the support arm mechanism includes an angle indicator operatively arranged to display the angle of the support arm mechanism relative to an angle indicating surface. And in yet another embodiment, the support arm mechanism includes means to adjust the angle of the support arm mechanism relative to the angle indicating surface.

A general object of the invention is to provide a support arm for an article, e.g., a keyboard.

Another object of the invention is to minimize the space required to store the support arm mechanism.

Yet another object of the invention is to provide positive feedback regarding ergonomic factors of the support arm mechanism configuration, e.g., support height and angle.

These and other objects, features, and advantages of the present invention will become readily apparent to one having ordinary skill in the art upon reading the detailed description of the invention in view of the drawings and appended claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred embodiment, it is to be understood that the invention as claimed is not limited to the preferred embodiment.

Furthermore, it is understood that this invention is not limited to the particular methodology, materials and modifications described and as such may, of course, vary. It is also understood that the terminology used herein is for the purpose of describing particular embodiments only, and is not intended to limit the scope of the present invention.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
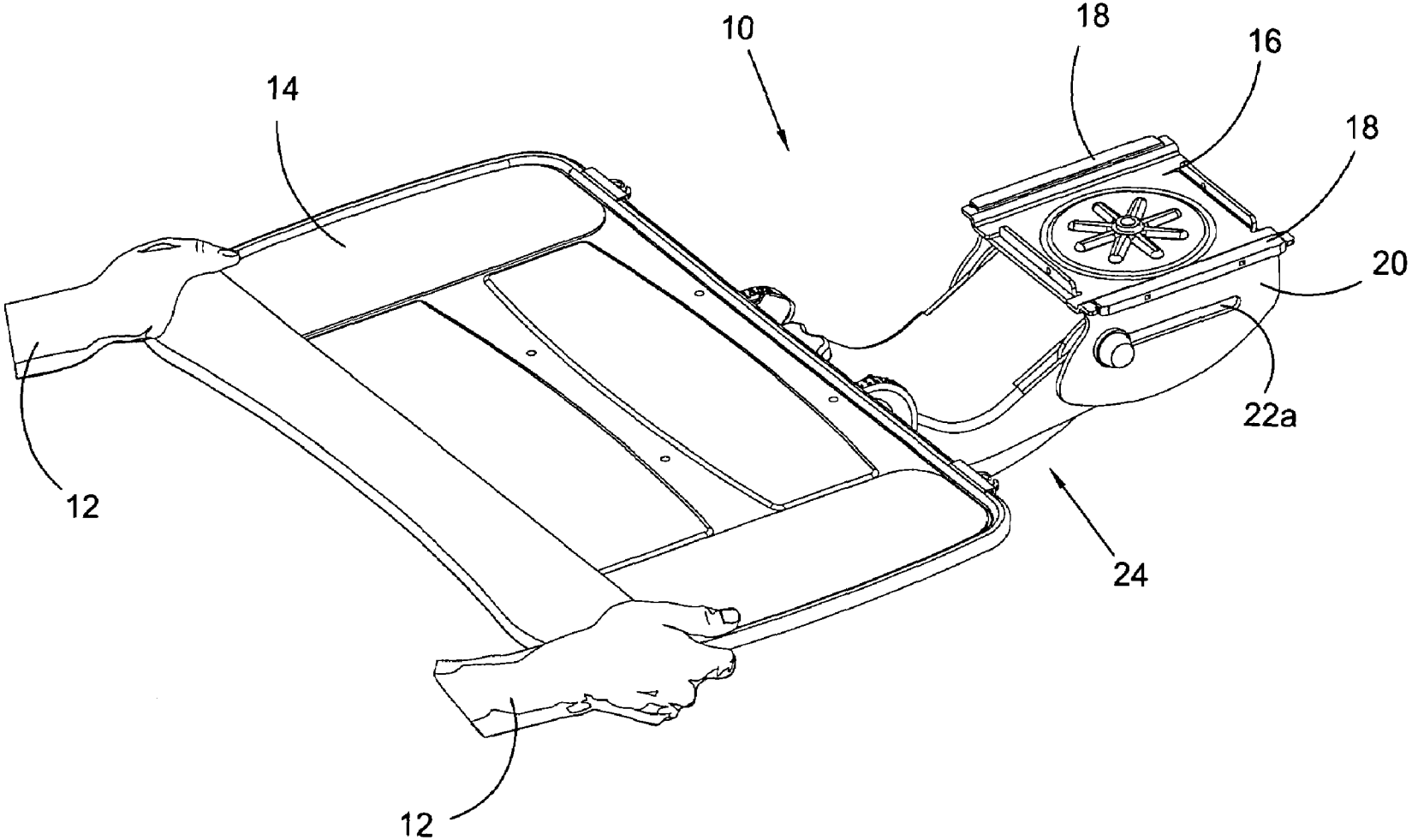
FIG. 1 is a perspective view of a support arm mechanism of the present invention showing a user gripping a support, wherein the support is fixedly secured to the support arm mechanism.

Adverting now to the figures, FIG. 1 shows a perspective view of support arm mechanism 10 of the present invention showing user 12 gripping support 14. Support 14 is fixedly secured to support arm mechanism 10, whereby forces exerted on support 14 are transferred to support arm mechanism 10. In this embodiment, glide plate 16 having glide channels 18 is rotatably secured to mounting member 20 so that support arm mechanism 10 may rotate relative to glide plate 16. Slots 22*a* and 22*b* (see FIG. 21) are disposed within mounting member 20, and are operatively arranged to permit transverse movement of linkage 24 therein. A more detailed description of the arrangement of linkage 24 and mounting member 20 is presented herebelow.

Figure 2:
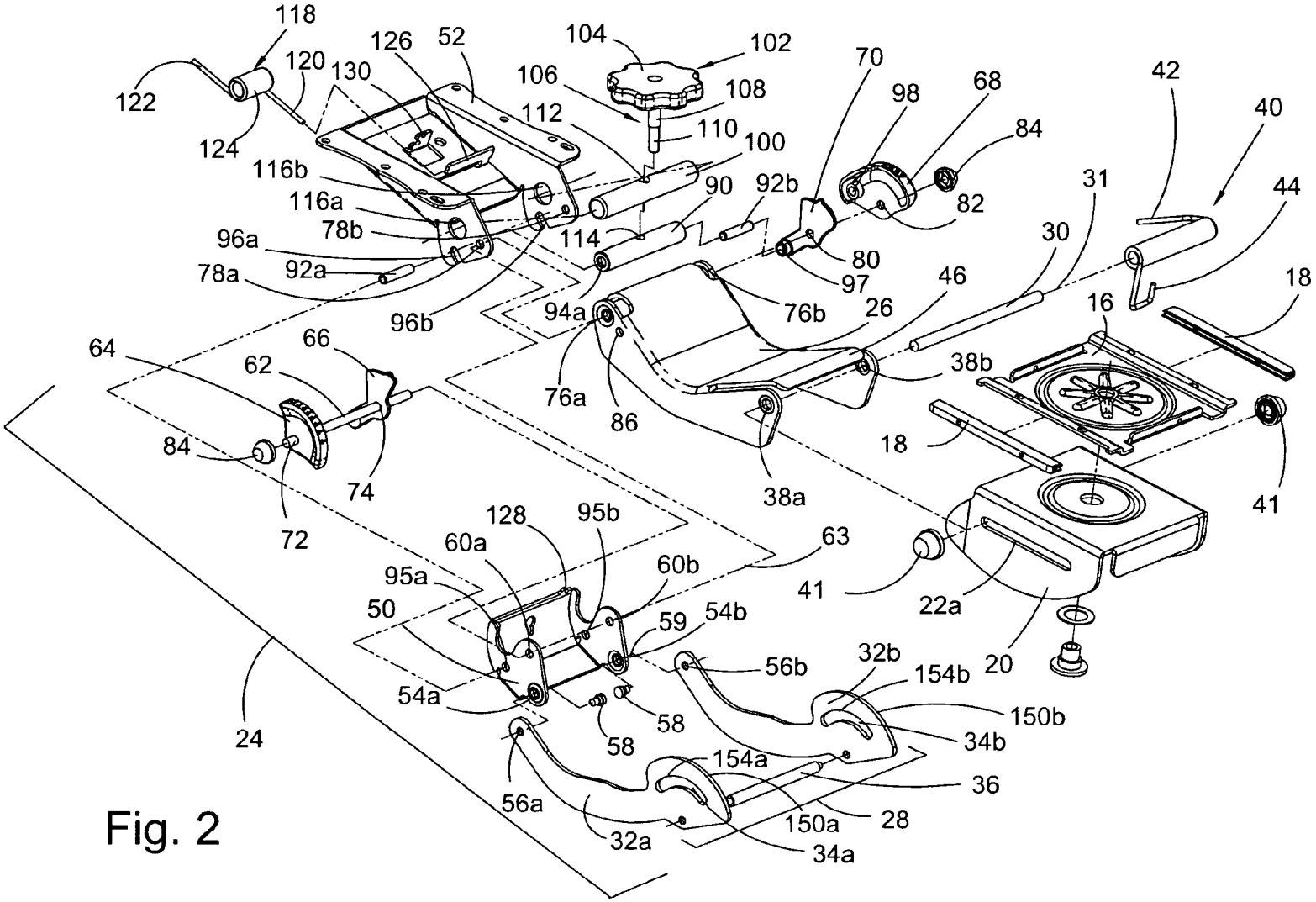
FIG. 2 is an exploded perspective view of the support arm mechanism of FIG. 1 shown without the support.
Figure 3:
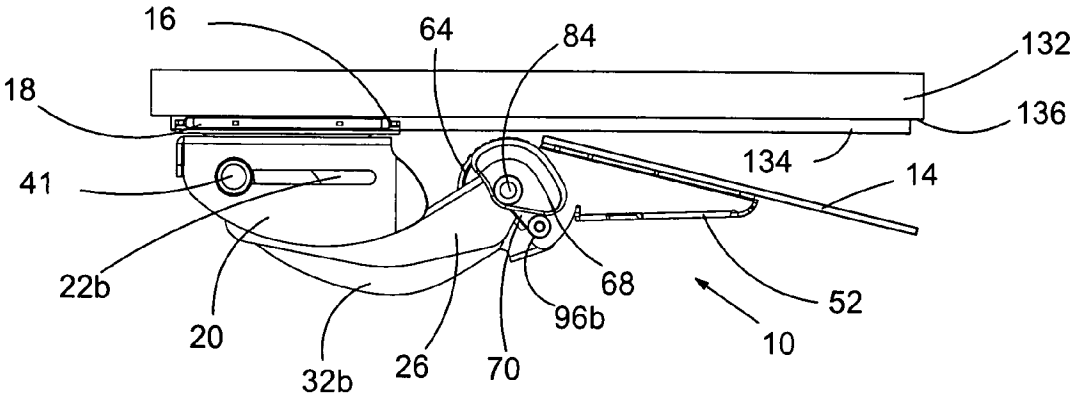
FIG. 3 is a side elevational view of the support arm mechanism of FIG. 1 shown in a fully retracted position, i.e., retracted along a glide track and within a slot.
Figure 4:
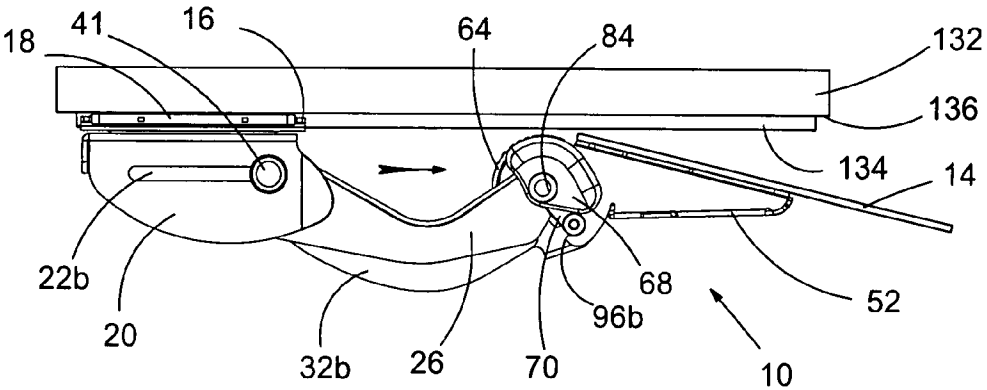
FIG. 4 is a side elevational view of the support arm mechanism of FIG. 1 shown in a first partially retracted position, i.e., retracted along the glide track and fully extended within the slot.
Figure 5:
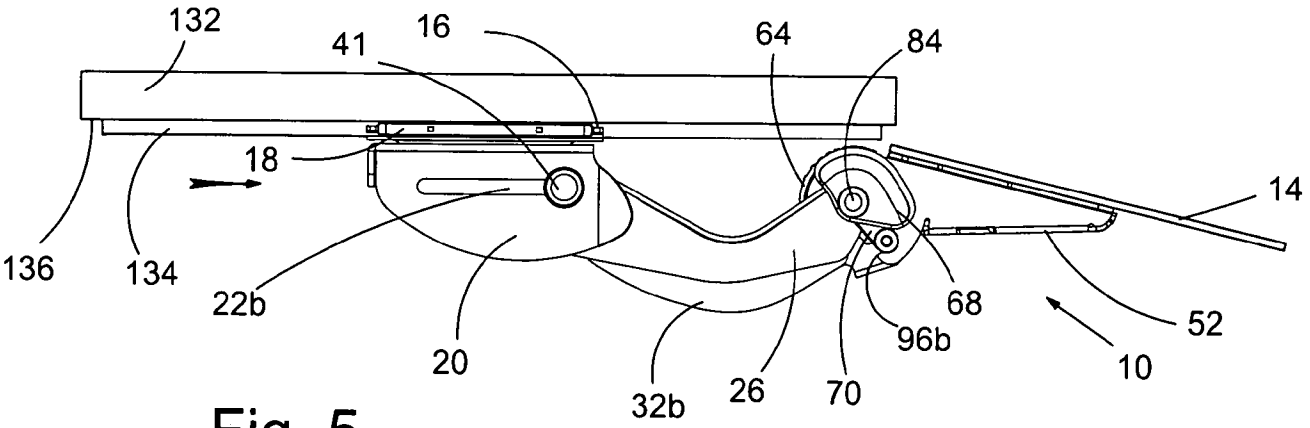
FIG. 5 is a side elevational view of the support arm mechanism of FIG. 1 shown in a second partially retracted position, i.e., partially retracted along the glide track and fully extended within the slot.
Figure 6:
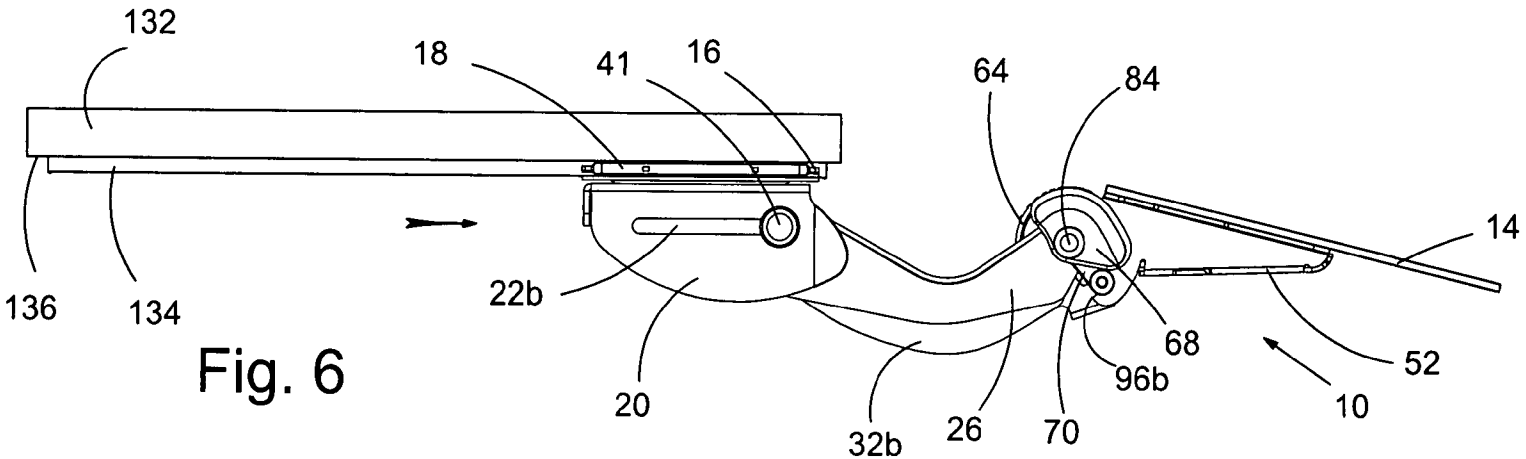
FIG. 6 is a side elevational view of the support arm mechanism of FIG. 1 shown in a fully extended position, i.e., fully extended along the glide track and fully extended within the slot.

FIG. 2 is an exploded perspective view of support arm mechanism 10 of FIG. 1 shown without support 14. In this figure, the structural arrangement of linkage 24 is better understood. First and second links 26 and 28, respectively, are engaged via pivot pin 30, thereby establishing first pivot axis 31 coincident with the axis of pivot pin 30. Second link 28 further comprises locking arms 32*a* and 32*b* having slots 34*a* and 34*b*, respectively and coupling pin 36. By disposing pivot pin 30 through mounting member slots 22*a* and 22*b* (see FIG. 21), pivot holes 38*a* and 38*b* within first link 26, biasing spring 40 and slots 34*a* and 34*b* within locking arms 32*a* and 32*b*, respectively, first link 26 and second link 28 are permitted to move relative to each other. As a means of retaining pivot pin 30 within the mechanism, end caps 41 are disposed at both ends of pivot pin 30. Biasing spring 40 includes first and second ends 42 and 44, respectively. First end 42, positioned against the bottom surface of flange 46 of first link 26, and second end 44, positioned against coupling pin 36 of second link 28, urgingly engages flange 46 and coupling pin 36 to provide rotational force whereby second link 28 translates with respect to first link 26 and pivot pin 30. The results of such rotational force are described in greater detail infra.

In this embodiment, third link 48 (see FIG. 9) includes tilt bracket 50 and tray bracket 52. Tilt bracket 50, having holes 54*a* and 54*b*, is rotatably secured to second link 28 via holes 56*a* and 56*b*, respectively, of locking arms 32*a* and 32*b*, respectively, by rivets 58, thereby establishing third pivot axis 59 coincident with the central axis of rivets 58. Although rivets 58 are depicted as the securing means between tilt bracket 50 and second link 28, one of ordinary skill in the art will appreciate that other means of securing tilt bracket 50 and second link 28 are within the scope of the invention as claimed, for example, a nut and bolt combination.

Tilt bracket 50 also includes holes 60*a* and 60*b* operatively arranged to be rotatably secured to first link 26 and tray bracket 52 via indicator pin 62, thereby establishing second pivot axis 63. Indicator pin 62 further constrains the movement of height indication scale 64, height indicator 66, angle indication scale 68 and angle indicator 70. More specifically, indicator pin 62 passes through, in order, hole 72 of height indication scale 64, hole 74 of height indicator 66, hole 76*a* of first link 26, hole 78*a* of tray bracket 52, hole 60*a* of tilt bracket 50, hole 60*b* of tilt bracket 50, hole 78*b* of tray bracket 52, hole 76*b* of first link 26, hole 80 of angle indicator 70 and lastly, hole 82 of angle indication scale 68. Also shown in FIG. 2 are end caps 84, whereby indicator pin 62 is retained within the mechanism, although end caps 84 are not particularly germane to the invention.

To further constrain rotation, height indication scale 64 includes a protrusion 85 that is fixedly engaged within hole 86 of first link 26, while height indicator 66 via a hole (not shown) is fixedly secured to first tilt bar 90 via engagement pin 92*a*. Thus, as first link 26 moves relative to engagement pin 92*a*, height indication scale 64 moves relative to height indicator 66. As depicted in FIG. 2, tilt bar 90 includes holes 94*a* and 94*b* (not shown) wherein engagement pins 92*a* and 92*b*, respectively, are fixedly secured. It should be appreciated that while engagement pins 92*a* and 92*b* are fixedly secured within holes 94*a* and 94*b*, respectively, first tilt bar 90 is disposed within tilt bracket 50, and thus pins 92*a* and 92*b* are first inserted through holes 95*a* and 95*b*, respectively. Pins 92*a* and 92*b* provide a limit for the movement of tray bracket 52 relative to tilt bracket 50, i.e., as tray bracket 52 is moved relative to tilt bracket 50, slots 96*a* and 96*b* of tray bracket 52 engage and disengage pins 92*a* and 92*b*, respectively.

In like fashion, the rotation of angle indicator 70 is constrained by fixedly securing hole 97 of indicator 70 to engagement pin 92*b*, while hole 98 of angle indication scale 68 is fixedly secured to second tilt bar 100 via a protrusion (not shown) located at the end of bar 100 proximate indicator scale 68. Thus, as second tilt bar 100 moves relative to first tilt bar 90, angle indicator scale 68 moves relative to angle indicator 70.

To effect an angular change between tilt bracket 50 and tray bracket 52, turnbuckle 102 is rotated. Turnbuckle 102 includes knob 104 having integral adjustment screw 106, wherein adjustment screw 106 has first and second thread pitches 108 and 110, respectively. First and second thread pitches 108 and 110 are operatively arranged so that first thread pitch 108 engages tapped hole 112 of second tilt bar 100, while second thread pitch engages tapped hole 114 of first tilt bar 90. Rotating knob 104, and thus screw 106, causes first and second tilt bars 90 and 100, respectively, to move closer and farther apart, and because second tilt bar 100 is inserted through holes 116*a* and 116*b* of tray bracket 52, as turnbuckle 102 is rotated, tilt bracket 50 and tray bracket 52 rotate relative to each other about second pivot axis 63, i e., the axis of indicator pin 62.

As support arm mechanism 10 may be used to support any number of articles, mechanism 10 must be capable of accommodating different masses. Effecting an angular change to tray bracket 52 may become exceedingly difficult when a large mass is supported, and contrarily may because too easy when a very small mass is supported. Thus, spring 118 having first and second ends 120 and 122, respectively, is operatively arranged so that coil 124 is disposed about tab 126, first end 120 urgingly engages tab 128 and second end 122 urgingly engages tab 130. By providing a plurality of engagement locations about tab 130 (see FIG. 7), the preload tension provided by spring 118 may be adjusted to accommodate articles of varying masses.

FIGS. 3, 4, 5 and 6 describe how support arm mechanism 10 may be positioned at various locations with respect to base 132. Glide track 134, attached to surface 136 of base 132, is operatively arranged to receive glide channels 18 and thereby support arm mechanism 10. The movement of support 14 is best described as movement relative to two objects, mounting member 20 and base 132. Movement relative to mounting member 20 is depicted by the differences between FIGS. 3 and 4. First pivot axis 31 is approximately located at the center of end cap 41. Thus, first pivot axis 31, which joins first and second links 26 and 28 (see FIG. 2), is shown moving from an end of slots 22*a* (not shown) and 22*b* farthest from support 14 (see FIG. 3) to an opposite end, i.e., closest to support 14 (see FIG. 4). Subsequently, movement relative to base 132 is depicted by the differences between FIGS. 4, 5 and 6. In these figures, glide channels 18 are shown at various locations along the length of glide track 134, thereby showing support 14 moving relative to base 132.

Figure 7:
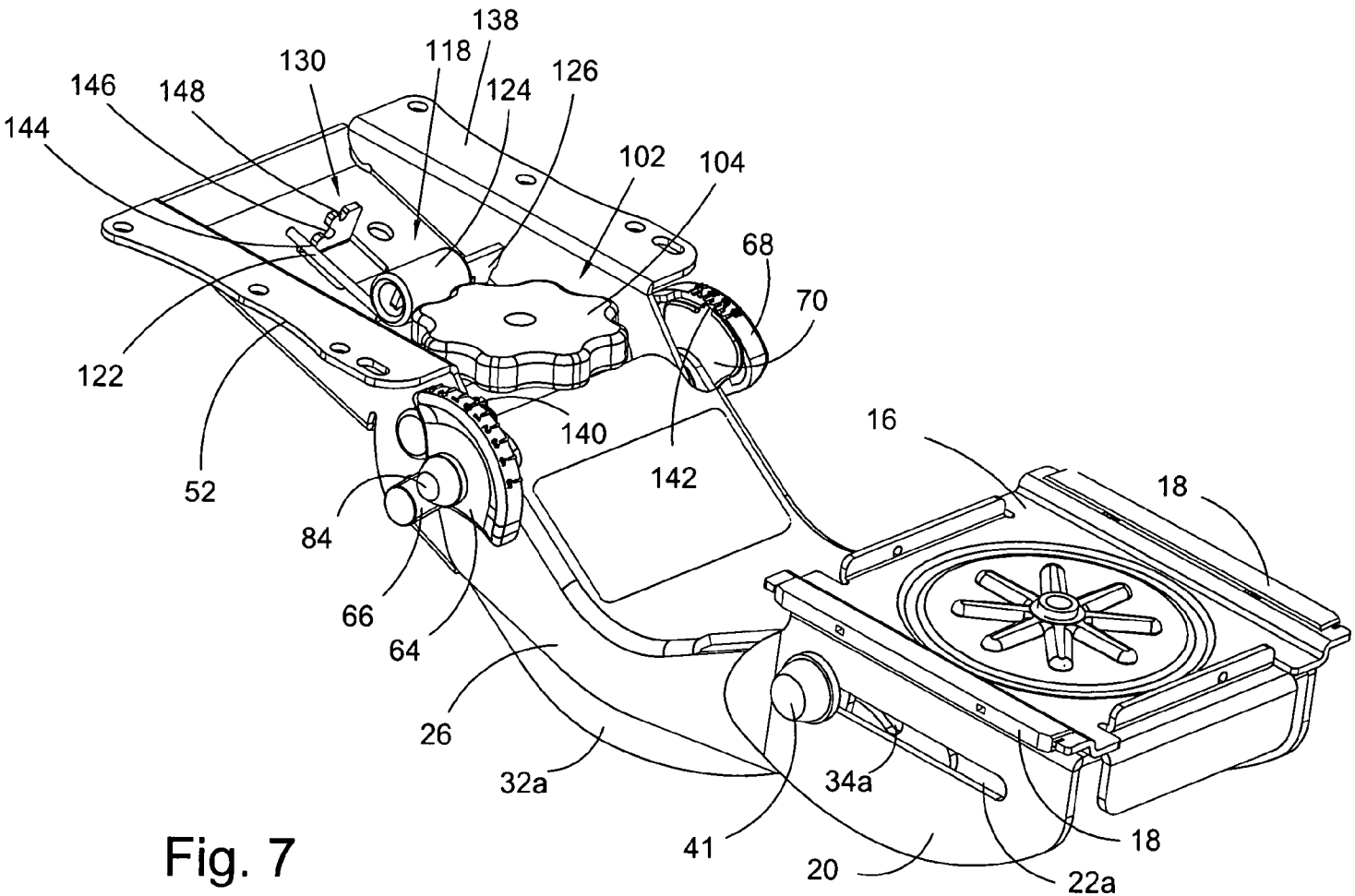
FIG. 7 is a perspective view of a support arm mechanism of the present invention shown without the support while disposed in a central use position and a zero tilt angle.

FIG. 7 is a perspective view of support arm mechanism 10 shown without support 14 while disposed in a central use position and a zero tilt angle. 'Use position' is described as the height of support 14, or mating surface 138 of tray bracket 52, relative to a height indicating surface, e.g., base 132 (see FIGS. 3, 4, 5 and 6), the floor (not shown) or surface 154 of glide channels 18 (see FIG. 10). 'Tilt angle' describes the angle formed between mating surface 138 and an angle indicating surface, e.g., base 132 (see FIGS. 3, 4, 5 and 6), the floor (not shown) or surface 155 of glide channels 18 (see FIG. 10). As FIG. 7 shows, when support arm mechanism 10 is in a central use position, pointer 140 of height indicator 66 is proximate the number zero on height indication scale 64. Similarly, when support arm mechanism 10 is in a zero tilt angle, pointer 142 of angle indicator 70 is proximate the number zero on angle indication scale 68.

Tab 130 is shown in greater detail in FIG. 7, specifically first, second and third tab notches 144, 146 and 148, respectively, are shown. As described supra, support arm mechanism 10 is capable of supporting articles of varying masses, while maintaining the ability to adjust the tilt angle. Thus, in order to maintain a consistent torque requirement for rotating turnbuckle 102 when adjusting the tilt angle, second end 122 of spring 118 may be moved from first tab notch 144 to second tab notch 146 to third tab notch 148 as the article mass increases.

Figure 8:
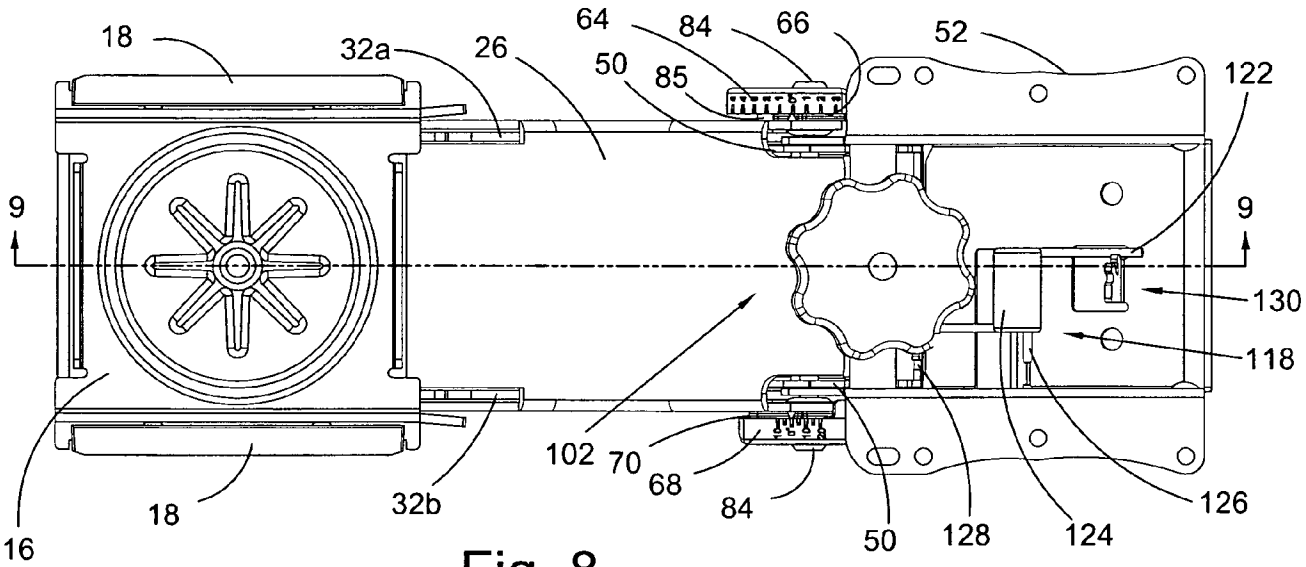
FIG. 8 is a top plan view of the support arm mechanism of FIG. 7.
Figure 9:
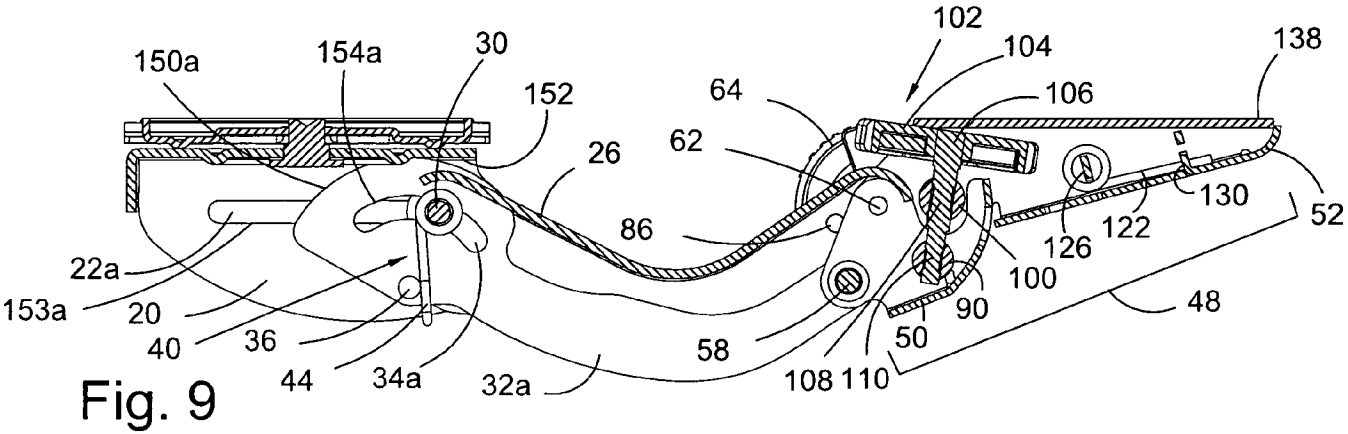
FIG. 9 is a cross sectional view of the support arm mechanism of FIG. 7 taken generally along line 9-9 in FIG. 8.

FIG. 8 is a top plan view of support arm mechanism 10 as shown in FIG. 7. From this perspective, height indication scale 64 and angle indicator scale 68 are more readily seen. While FIG. 9, showing a cross sectional view of support arm mechanism 10 taken generally along line 9-9 in FIG. 8, more clearly depicts the three bar linkage arrangement, as it relates to this embodiment of the invention. First, second and third links 26, 28 (only coupling pin 36 and locking arm 32*a* are shown) and 48, respectively, provide means to releasably secure support 14 (not shown) in a desired position. In a rest state, bearing surfaces 150*a* and 150*b* (see FIG. 2) of locking arms 32*a* and 32*b* (not shown), respectively, frictionally engage surface 152 of mounting member 20, while bearing surfaces 154*a* and 154*b* (see FIG. 2) of slots 34*a* and 34*b* (not shown), respectively, frictionally engage pivot pin 30 thereby causing pivot pin 30 to frictionally engage bearing surfaces 153*a* and 153*b* (see FIG. 21) of slots 22*a* and 22*b* (not shown), respectively. It should be appreciated that bearing surfaces 150*a* and 150*b* are also referred to as link locking surfaces. Applying a lifting force to tray bracket 52, in turn lifts tilt bracket 50 via the connection formed by first and second tilt bars 90 and 100, respectively, and turnbuckle 102. Thus, applying a lifting force to tray bracket 52 lifts tilt bracket 50, thereby moving rivets 58, i.e., third pivot axis 59, relative to indicator pin 62, i.e., second pivot axis 63. The movement of second and third pivot axes 63 and 59, respectively, releases the frictional engagement of bearing surfaces 150*a* and 150*b* from surface 152, bearing surfaces 154*a* and 154*b* from pivot pin 30, and pivot pin 30 from bearing surfaces 153*a* and 153*b*, thereby permitting support 14 to move about first pivot axis 31 and within slots 22*a* and 22*b*. Subsequently, by releasing the lifting force applied to tray bracket 52, bearing surfaces 150*a* and 150*b* reengage locking surface 152, bearing surfaces 154*a* and 154*b* reengage pivot pin 30 and pivot pin 30 reengages bearing surfaces 153*a* and 153*b*, thereby releaseably securing the position of support 14. Thus, in some embodiments, the present invention includes locking means, i.e., bearing surfaces 150*a* and 150*b* in combination surface 152, bearing surfaces 154*a* and 154*b* in combination with pivot pin 30 and pivot pin 30 in combination with bearing surfaces 153*a* and 153*b*, collectively.

An embodiment of a means for effecting a tilt angle change is also shown in FIG. 9. As turnbuckle 102 is rotated, thereby rotating adjustment screw 106 and in turn first and second thread pitches 108 and 110, respectively, first and second tilt bars 90 and 100, respectively, are moved together and apart along the direction of adjustment screw 106. In so doing, tray bracket 52 and tilt bracket 50 move relative to each other about indicator pin 62, i.e., second pivot axis 63. As brackets 50 and 52 move relative to each other, the tilt angle of support arm mechanism 10 is modified.

Figure 10:
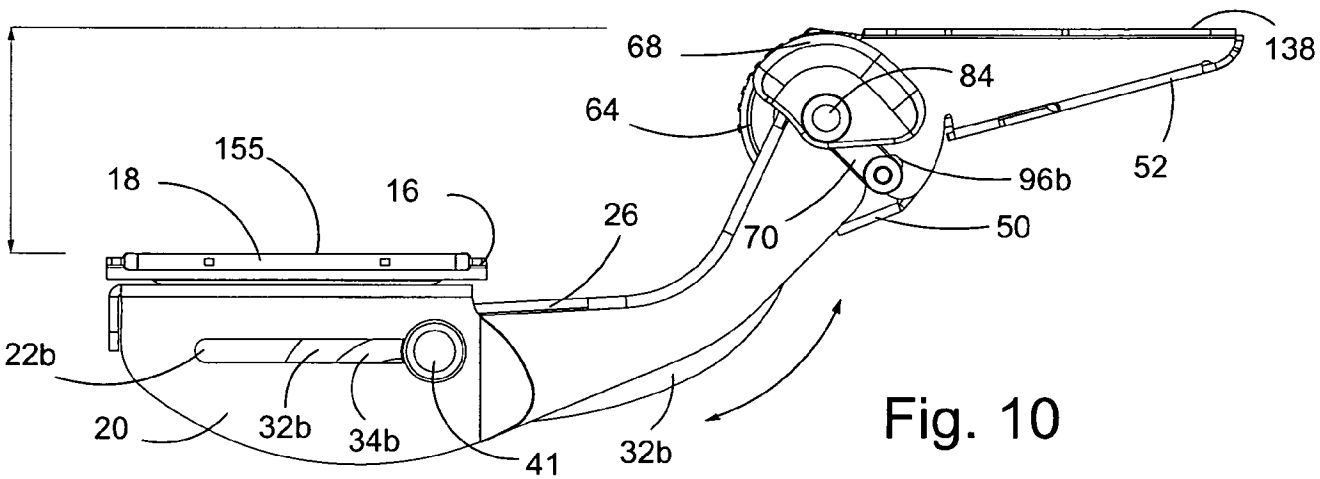
FIG. 10 is a side elevational view of a support arm mechanism of the present invention shown without the support while disposed in an upper use position and a zero tilt angle.
Figure 11:
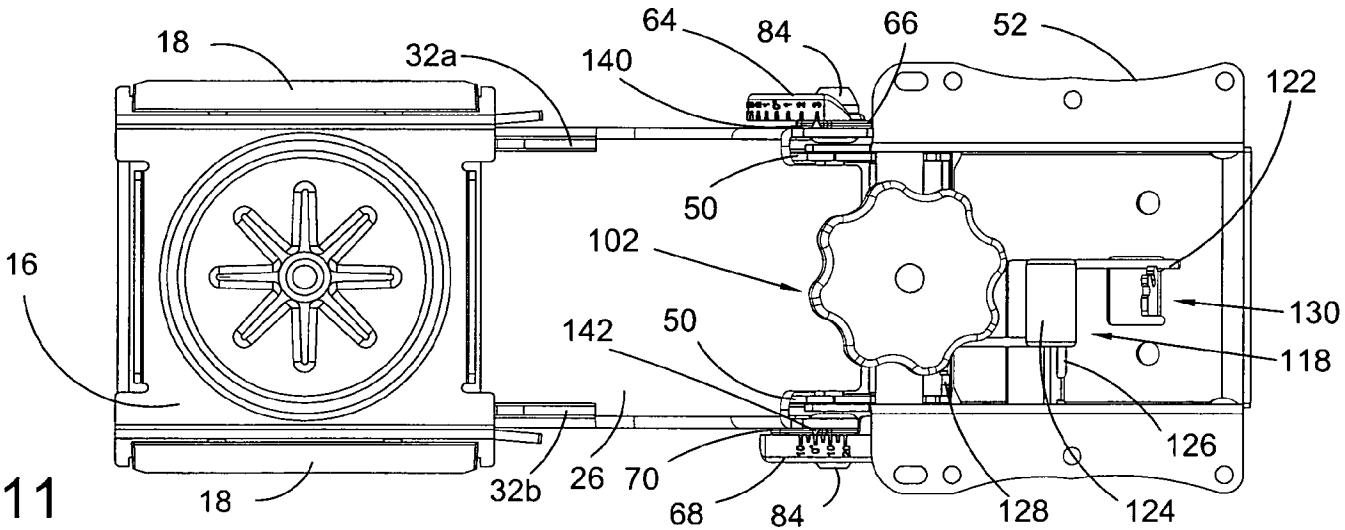
FIG. 11 is a top plan view of the support arm mechanism of FIG. 10.

Next FIGS. 10 and 11 show support arm mechanism 10 while disposed in an upper use position and a zero tilt angle. As described supra, by applying a lifting force to tray bracket 52, the height of surface 138 relative to a height indicating surface, e.g., upper surface 155 of glide channel 18, may be changed. The embodiment shown in FIGS. 10 and 11 depicts surface 138 approximately three inches above upper surface 155, as shown by pointer 140 being proximate the number three on height indication scale 64. Although the height of surface 138 has changed, the tilt angle of surface 138 relative to upper surface 155 has remained unchanged. Thus, pointer 142 is proximate the number zero on angle indication scale 68.

Figure 12:
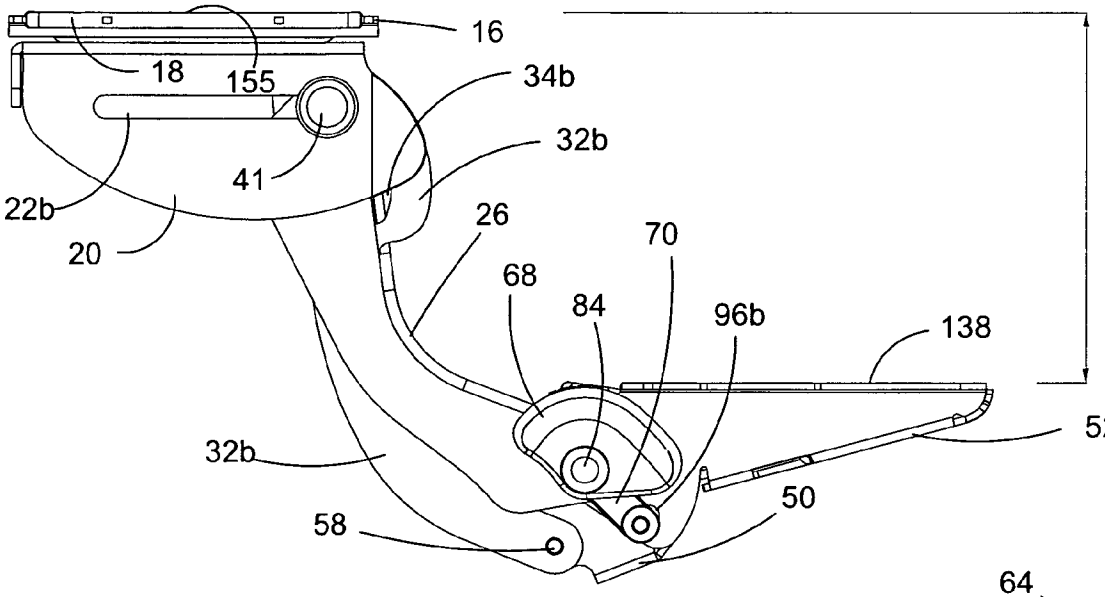
FIG. 12 is a side elevational view of a support arm mechanism of the present invention shown without the support while disposed in a lower use position and a zero tilt angle.
Figure 13:
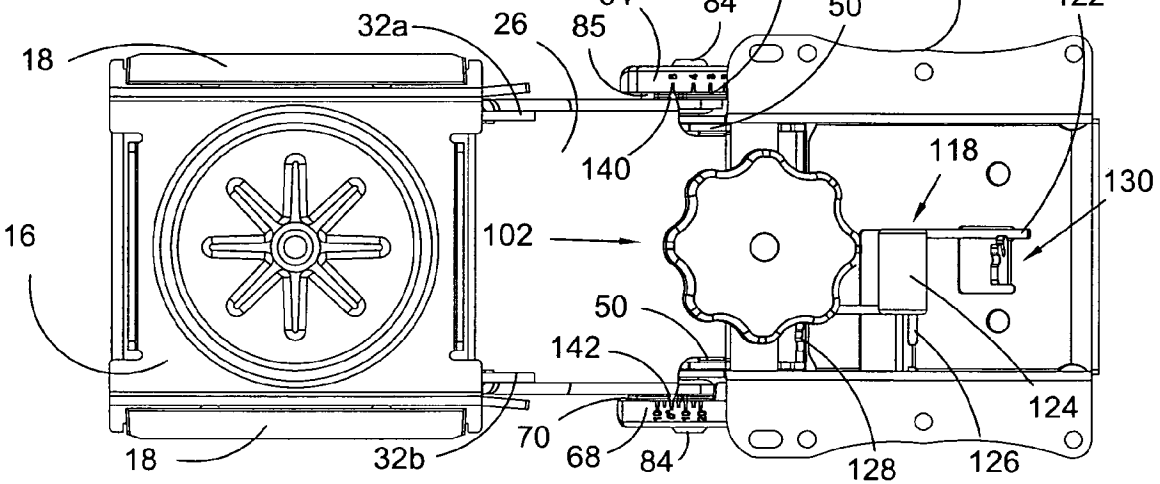
FIG. 13 is a top plan view of the support arm mechanism of FIG. 12.

In like fashion, FIGS. 12 and 13 show support arm mechanism 10 while disposed in a lower use position and a zero tilt angle. Again, by applying a lifting force to tray bracket 52, the height of surface 138 relative to a height indicating surface, e.g., upper surface 155 of glide channel 18, may be changed, in this embodiment lowering the height. This embodiment shows surface 138 approximately five inches below upper surface 155, as shown by pointer 140 being proximate the number five on height indication scale 64. And again, although the height of surface 138 has changed, the tilt angle of surface 138 relative to upper surface 155 has remained unchanged. Thus, pointer 142 is proximate the number zero on angle indication scale 68.

Figure 14:
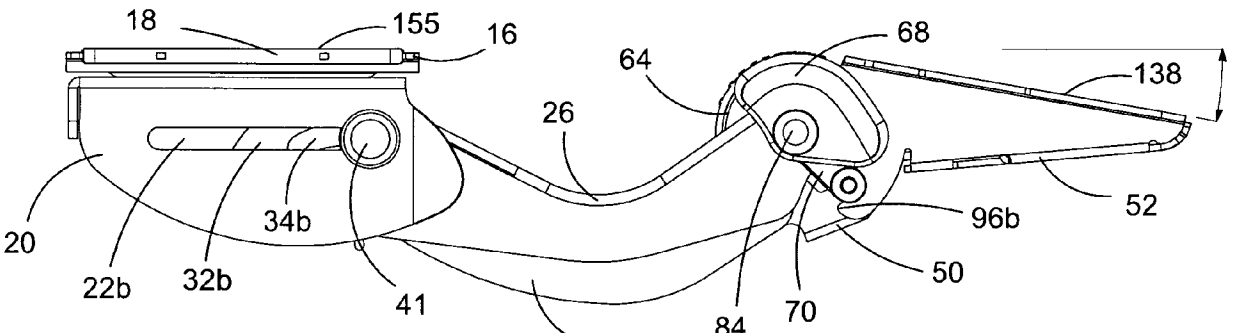
FIG. 14 is a side elevational view of a support arm mechanism of the present invention shown without the support while disposed in a central use position and a positive tilt angle.
Figure 15:
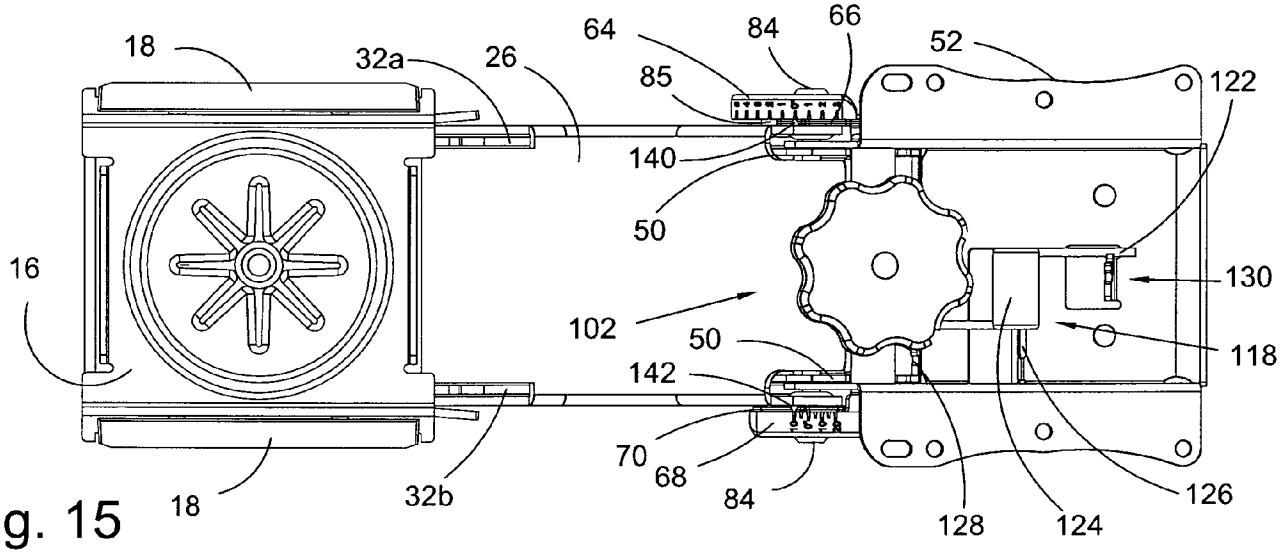
FIG. 15 is a top plan view of the support arm mechanism of FIG. 14.

FIGS. 14 and 15 show support arm mechanism 10 while disposed in a central use position and a positive tilt angle. As described supra, rotating turnbuckle 102 alters the angle formed between surface 138 and upper surface 155, i.e., the tilt angle. In this embodiment, the tilt angle is approximately positive ten degrees, or in other words, a ten degree tilt below upper surface 155. Thus, FIG. 15 shows pointer 142 proximate the number ten on angle indication scale 68. And as this embodiment is in a central use position, pointer 140 is disposed proximate the number zero on height indication scale 64.

Figure 16:
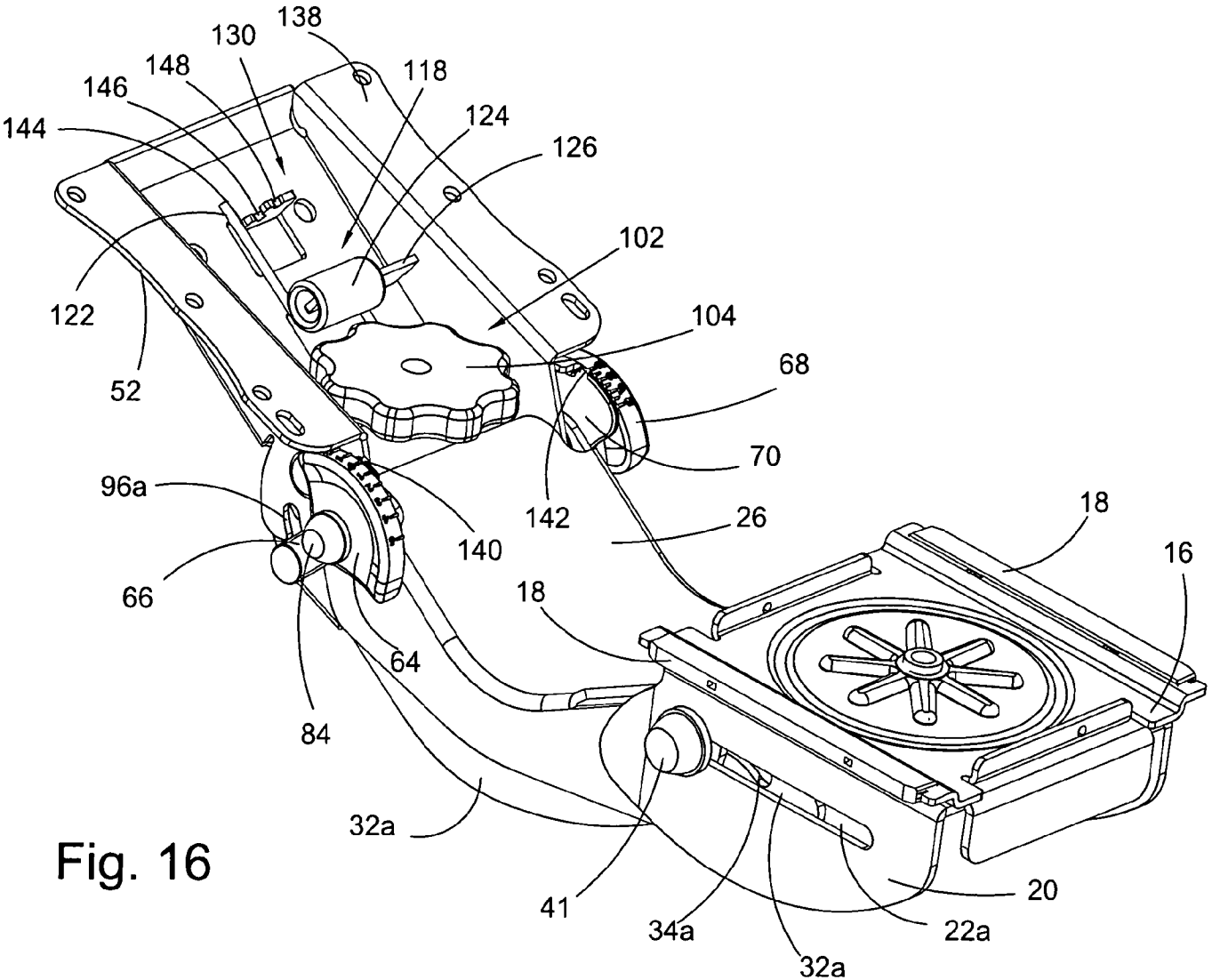
FIG. 16 is a perspective view of a support arm mechanism of the present invention shown without the support while disposed in a central use position and a negative tilt angle.
Figure 17:
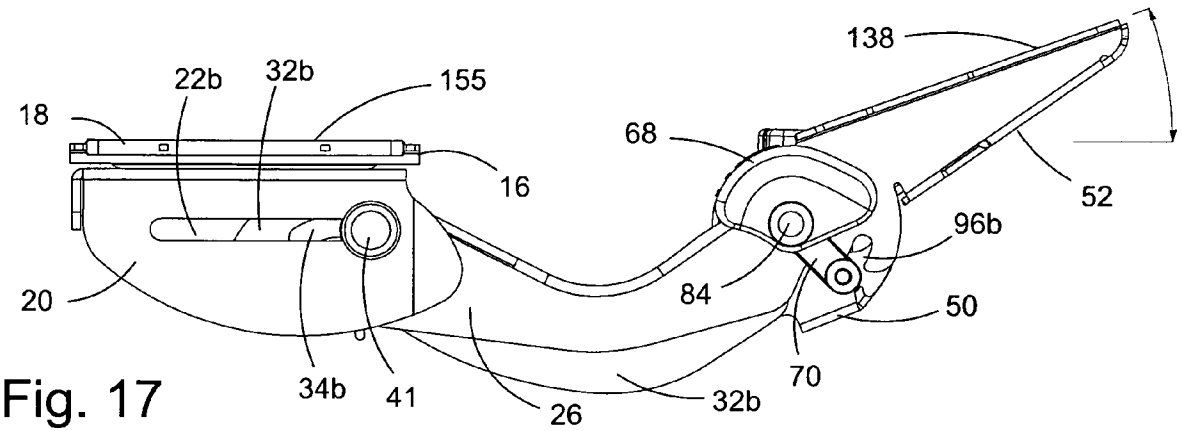
FIG. 17 is a side elevational view of the support arm mechanism of FIG. 16.
Figure 18:
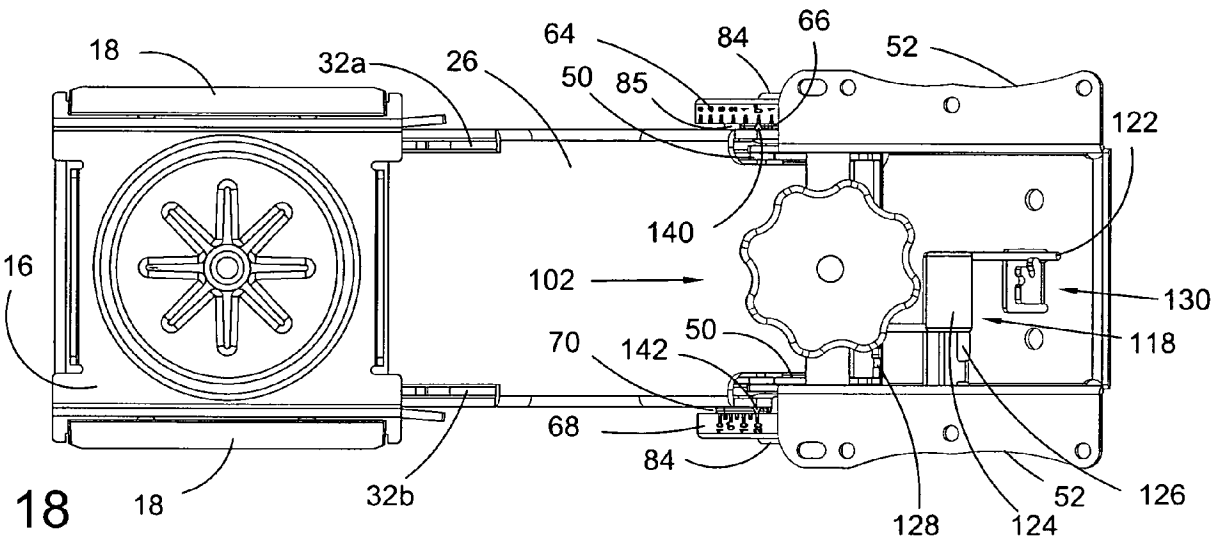
FIG. 18 is a top plan view of the support arm mechanism of FIG. 16.

Next, FIGS. 16, 17 and 18 show support arm mechanism 10 while disposed in a central use position and a negative tilt angle. In this embodiment, the tilt angle is approximately negative twenty degrees, or in other words, a twenty degree tilt above upper surface 155. Thus, FIG. 16 shows pointer 142 proximate the number twenty on angle indication scale 68. And similarly, as this embodiment is in a central use position, pointer 140 is disposed proximate the number zero on height indication scale 64.

Figure 20:
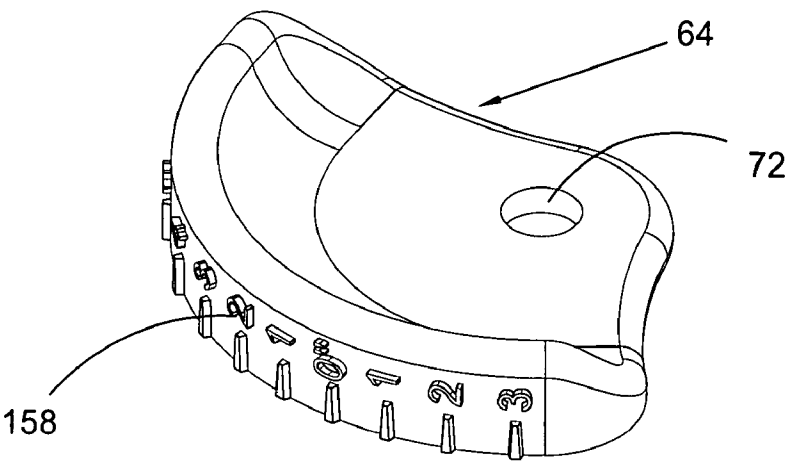
FIG. 20 is a perspective view of a height indicator scale of a support arm mechanism of the present invention.
Figure 19:
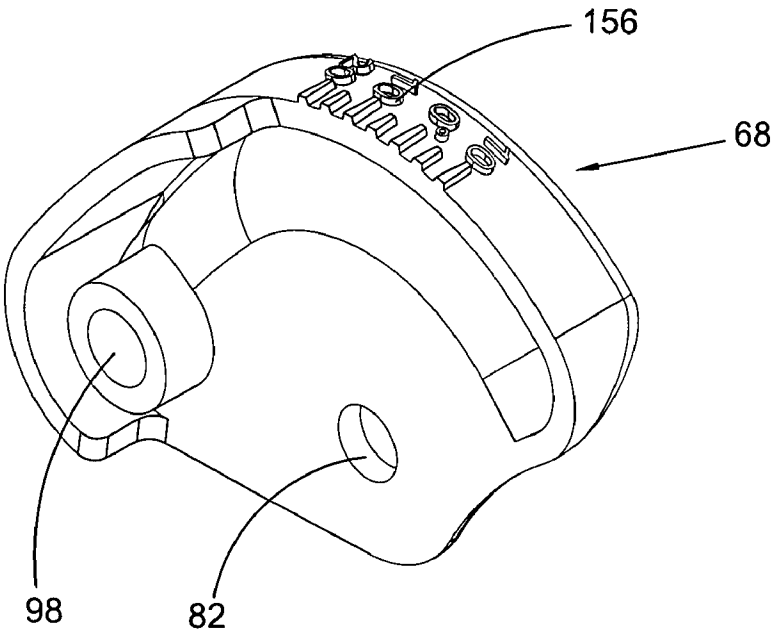
FIG. 19 is a perspective view of an angle indicator scale of a support arm mechanism of the present invention.

FIGS. 19 and 20 show perspective views of angle indication scale 68 and height indication scale 64, respectively. In this embodiment, angle indication scale 68 includes angle gradations 156, while height indication scale 64 includes height gradations 158. Angle gradations 156, in this embodiment, cover tilt angles from positive ten degrees through negative twenty degrees. Similarly, height gradations 158 cover a range below and above a central height, i.e., negative five inches through positive three inches. Although angle and height gradations 156 and 158, respectively, cover the angles and heights described herein, one of ordinary skill in the art would know that modifying several components of support arm mechanism 10, e.g., second link 28 or adjustment screw 106, the ranges covered by angle and height indication scales 68 and 64, respectively, may be increased or decreased. Additionally, it is equally apparent to one of ordinary skill in the art that although raised numbers are used to establish angle and height gradations 156 and 158, respectively, other means of displaying a scale are within the scope of the invention as claimed, e.g., screen printed or stamped gradations.

Figure 21:
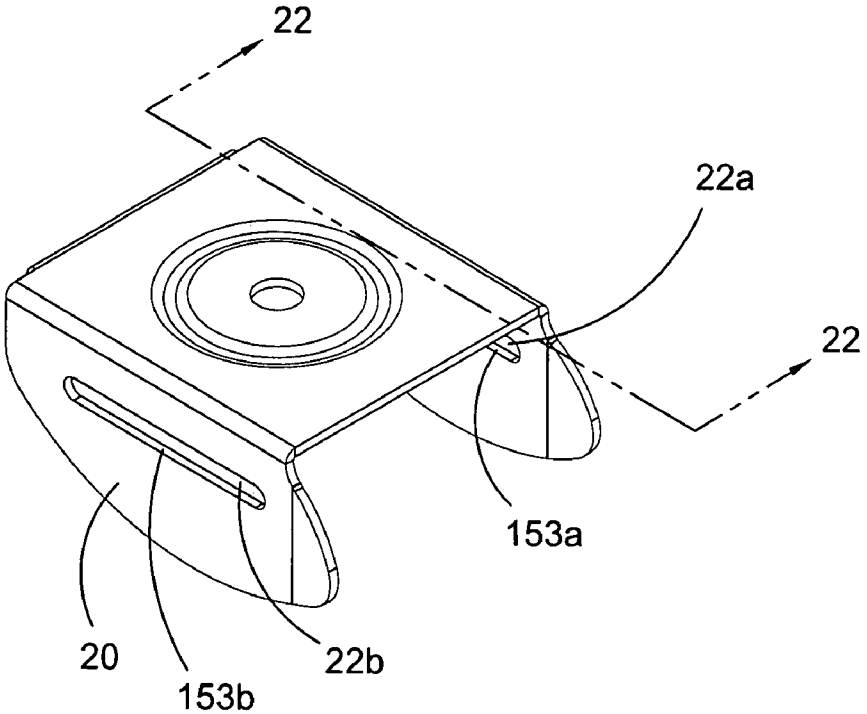
FIG. 21 is a perspective view of a mounting member of a support arm mechanism of the present invention.
Figure 22:
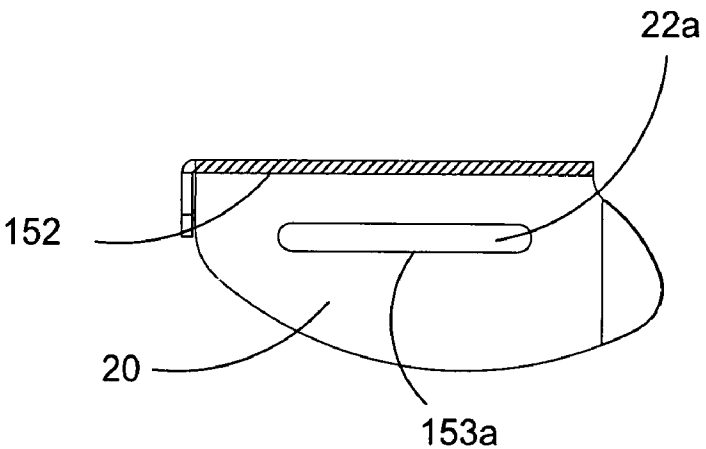
FIG. 22 is a cross sectional view of the mounting member of FIG. 21 taken generally along line 22-22 of FIG. 21.

FIG. 21 is a perspective view of mounting member 20 of support arm mechanism 10, while FIG. 22 shows a cross sectional view of mounting member 20 taken generally along line 22-22 of FIG. 21. Surface 152 is operatively arranged to be parallel to slots 22*a* and 22*b*, and therefore parallel to bearing surfaces 153*a* and 153*b*. Regardless of the position of linkage 24 within slots 22*a* and 22*b* (see FIGS. 3 and 4), the distance between surface 152 and bearing surfaces 153*a* and 153*b* remains constant. Thus, linkage 24 may be positioned in any location within slots 22*a* and 22*b*, as well as positioned at any height within the range described above, while being releasably retained.

Although the embodiments shown in the figures are directed at horizontal sliding movement of support arm mechanism 10, one of ordinary skill in the art would recognize that other configurations are also possible, e.g., vertical or diagonal sliding movement of support arm mechanism 10. In such an embodiment, mounting member 20 would be operatively arranged so that surface 152 and slots 22*a* and 22*b* are vertical. Provided that surface 152 and slots 22*a* and 22*b* are parallel, any configuration between horizontal and vertical is also probable. Equally apparent to one of ordinary skill in the art is the reversal of support arm mechanism 10, wherein mounting member 20 is fixedly secured to support 14, while tray bracket 52 is fixedly secured to a base, e.g., surface 136 of base 132. Such an embodiment would permit support 14 to pivot and/or translate relative to linkage 24.

Figure 23:
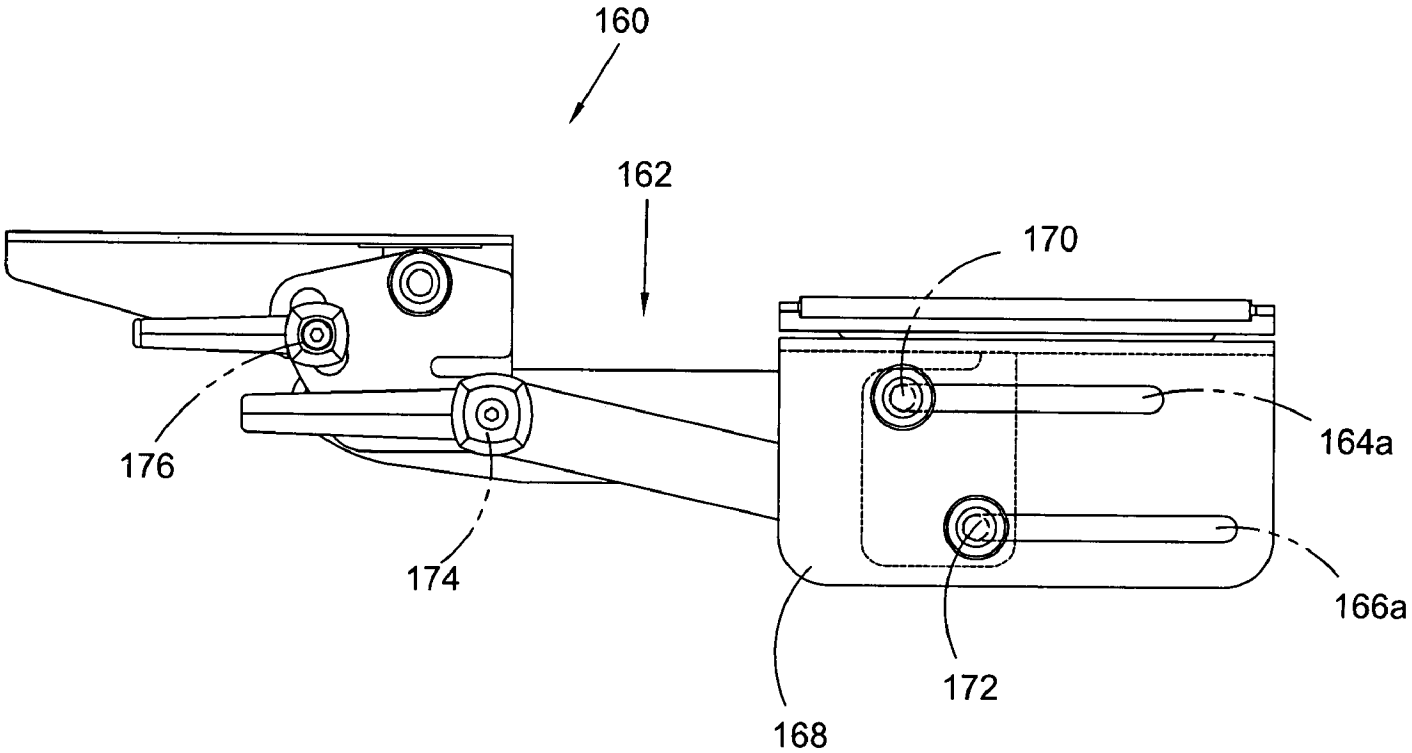
FIG. 23 is a side elevational view of a further embodiment of a support arm mechanism of the instant invention.
Figure 24:
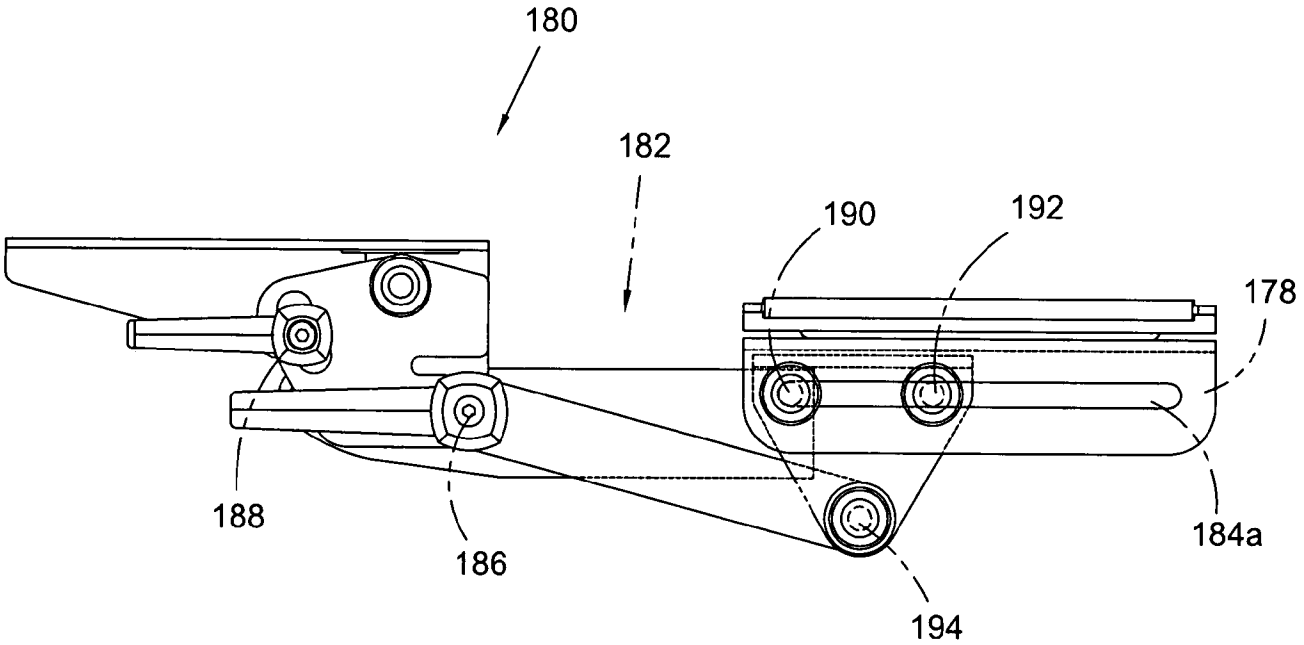
FIG. 24 is a side elevational view of another embodiment of a support arm mechanism of the instant invention; and, FIG. 25 is a side elevational view of yet another embodiment of a support arm mechanism of the instant invention.
Figure 25:
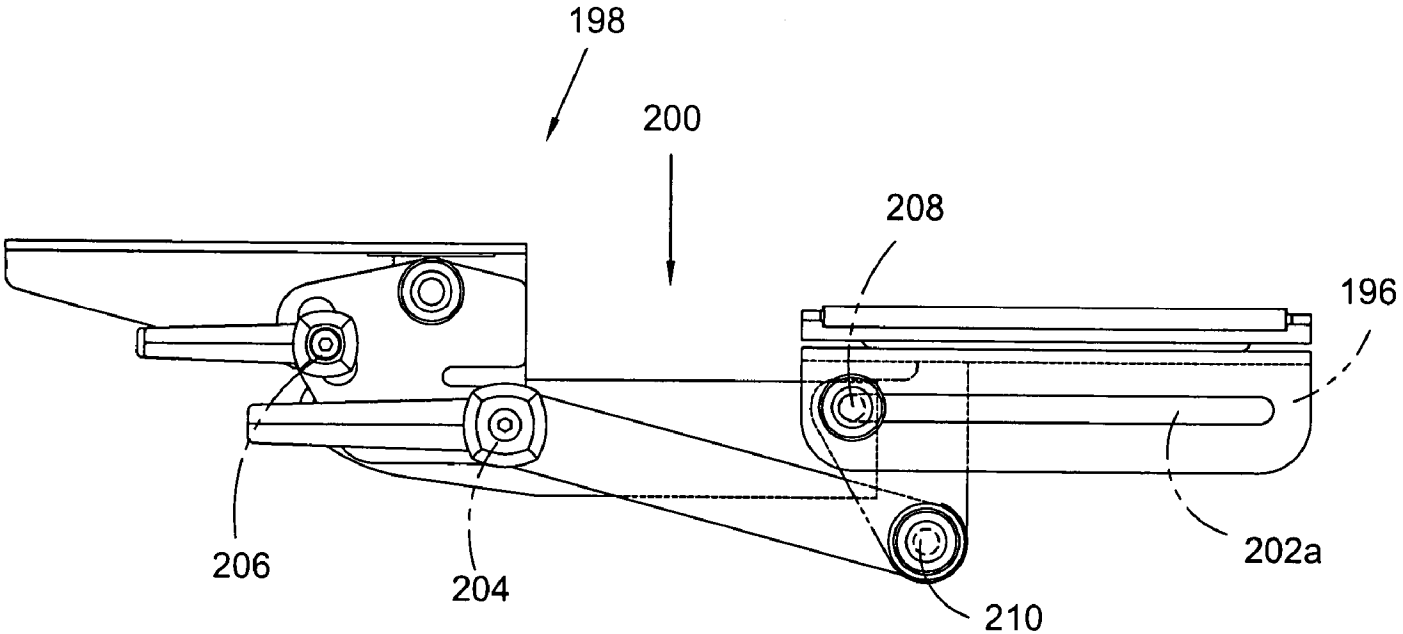

Additionally, the instant invention may be used with support mechanisms having greater than three links. FIGS. 23, 24 and 25 show support arm mechanisms having at least three links and include various embodiments of the instant invention mounting member. FIG. 23 depicts support arm mechanism 160, including four bar linkage 162, disposed within slots 164*a* and an opposing slot (not shown) and 166*a* and an opposing slot (not shown) of mounting member 168. In this embodiment, mounting member 168 includes two slots per wall, i.e., 164*a* /166*a* and a pair of slots arranged opposite slots 164*a* and 166*a* (not shown), wherein linkage 162 is disposed and operatively arranged for transverse movement within slots 164*a* 166*a* the pair of slots arranged opposite 164*a* and 166*a*, and rotational movement about pivot means 170 and 172. Contrary to the locking and bearing surface embodiments described supra, this embodiment relies upon locking devices 174 and 176 to maintain support height and angular locations, respectively, while still providing additional support travel distance, i.e., the length of slots 164*a* and 166*a*.

FIG. 24 shows another embodiment of the instant invention, specifically mounting member 178, wherein support arm mechanism 180 is releaseably secured. Similar to the device shown in FIG. 23, support arm mechanism 180 includes four bar linkage 182, however in this embodiment mounting member 178 merely includes slots 184*a* and an opposing slot (not shown). In like fashion, locking devices 186 and 188 are operatively arranged to releaseably secure the height and angular locations, respectively, of support arm mechanism 180. Likewise, pivot means 190, 192 and 194 are operatively arranged to permit transverse movement of linkage 182 within slots 184*a* and the opposing slot (not shown), and pivotal movement about pivot means 190, 192 and 194.

Lastly, FIG. 25 shows yet another embodiment of the instant invention, specifically mounting member 196, wherein support arm mechanism 198 is releaseably secured. Similar to the devices shown in FIGS. 23 and 24, support arm mechanism 198 includes four bar linkage 200, however mounting member 196 is similar to mounting member 178 (see FIG. 24) in that it merely includes slots 202*a* and an opposing slot (not shown). In like fashion, locking devices 204 and 206 are operatively arranged to releaseably secure the height and angular locations, respectively, of support arm mechanism 198. Likewise, pivot means 208 and 210 are operatively arranged to permit transverse movement of linkage 200 within slots 202*a* and the opposing slot (not shown), and pivotal movement about pivot means 208 and 210.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed:

1. A mechanism for mounting a support for movement relative to a base, said mechanism having a three bar linkage, said three bar linkage comprising a first link, a second link and a third link, each of said links having a first end and a second end, respectively, said three bar linkage further comprising a first pivot means, a second pivot means and a third pivot means, wherein a first pivot axis, a second pivot axis and a third pivot axis of said first, second and third pivot means, respectively, are parallel to one another, said first end of said first link attached by said first pivot means to said first end of said second link, said second end of said first link attached by said second pivot means to said third link, said second end of said second link attached by said third pivot means to said third link, said third link operatively arranged to be attached to said support, said mechanism further comprising:

a mounting member operatively arranged to be attached to said base, said mounting member having a locking surface and a pair of parallel spaced apart walls operatively arranged to extend away from said base, each of said walls having a slot, wherein said slots are parallel to said locking surface, and said slots are operatively arranged to slidingly and pivotally attach to at least one of said links by at least one of said pivot means to permit movement of said three bar linkage about at least one of said pivot axis and to permit transverse movement of said three bar linkage parallel to said slots.

2. The mechanism for mounting a support for movement relative to a base according to claim 1, wherein said walls are integral to said locking surface.

3. The mechanism for mounting a support for movement relative to a base according to claim 1, wherein the slots are selected from the group consisting of vertical, horizontal and orientations therebetween.

4. The mechanism for mounting a support for movement relative to a base according to claim 1, wherein said third link further comprises at least two brackets.

5. The mechanism for mounting a support for movement relative to a base according to claim 1, wherein said first and second links are slidingly and pivotally attached to said slots by said first pivot means.

6. The mechanism for mounting a support for movement relative to a base according to claim 1, wherein a manual application of lifting force to said support permits at least one of pivotal and translational movement of said three bar linkage about one of said pivot axis and permits transverse movement of said three bar linkage parallel to said slots.

7. The mechanism for mounting a support for movement relative to a base according to claim 1 further comprising a height indicator fixedly secured to at least one of said links and operatively arranged to indicate a height of said support relative to a height indicating surface, wherein said height indicator moves relative to a rotational axis which is coincident with one of said pivot axis.

8. The mechanism for mounting a support for movement relative to a base according to claim 7, wherein said height indicating surface is operatively arranged to be coplanar with said base.

9. The mechanism for mounting a support for movement relative to a base according to claim 7, wherein said height indicating surface is operatively arranged to be coplanar with a floor.

10. The mechanism for mounting a support for movement relative to a base according to claim 7, wherein said height indicator movement relative to said rotational axis is selected from the group consisting of rotational, translational and combinations thereof.

11. The mechanism for mounting a support for movement relative to a base according to claim 7, wherein said height indicator is fixedly secured to said first and third links and moves relative to said rotational axis which is coincident with said second pivot axis.

12. The mechanism for mounting a support for movement relative to a base according to claim 7, wherein said height indicator is fixedly secured to said first link and moves relative to said rotational axis which is coincident with said first pivot axis.

13. The mechanism for mounting a support for movement relative to a base according to claim 7, wherein said height indicator is fixedly secured to said second and third links and moves relative to said rotational axis which is coincident with said third pivot axis.

14. The mechanism for mounting a support for movement relative to a base according to claim 7, wherein said height indicator is fixedly secured to said first link and said mounting member and said height indicator moves relative to said rotational axis which is coincident with said first pivot axis.

15. The mechanism for mounting a support for movement relative to a base according to claim 1 further comprising an angle indicator fixedly secured to said third link and operatively arranged to indicate the angle of said support relative to an angle indicating surface, wherein said angle indicator moves relative to a rotational axis which is coincident with one of said pivot axis.

16. The mechanism for mounting a support for movement relative to a base according to claim 15, wherein said angle indicator movement relative to said rotational axis is selected from the group consisting of rotational, translational and combinations thereof.

17. The mechanism for mounting a support for movement relative to a base according to claim 15, wherein said rotational axis is said second pivot axis.

18. The mechanism for mounting a support for movement relative to a base according to claim 15, wherein said rotational axis is said third pivot axis.

19. The mechanism for mounting a support for movement relative to a base according to claim 15, wherein said third link further comprises at least a first bracket and a second bracket.

20. The mechanism for mounting a support for movement relative to a base according to claim 19, wherein said angle indicator is fixedly secured to said first and second brackets.

21. The mechanism for mounting a support for movement relative to a base according to claim 1 further comprising means for adjusting the angle of said support relative to an angle indicating surface.

22. The mechanism for mounting a support for movement relative to a base according to claim 21, wherein said third link further comprises at least a first bracket and a second bracket.

23. The mechanism for mounting a support for movement relative to a base according to claim 22, wherein said means for adjusting the angle of said support relative to said angle indicating surface is operatively arranged to change the angle of said first bracket relative to said second bracket.

24. A mechanism for mounting a support for movement relative to a base, said mechanism having a three bar linkage, said three bar linkage comprising a first link, a second link and a third link, each of said links having a first end and a second end, respectively, said three bar linkage further comprising a first pivot means, a second pivot means and a third pivot means, wherein a first pivot axis, a second pivot axis and a third pivot axis of said first, second and third pivot means, respectively, are parallel to one another, said first end of said first link attached by said first pivot means to said first end of said second link, said second end of said first link attached by said second pivot means to said third link, said second end of said second link attached by said third pivot means to said third link, said third link operatively arranged to be attached to said support, said mechanism further comprising:

a mounting member operatively arranged to be attached to said base, said mounting member having a locking surface and a pair of parallel spaced apart walls operatively arranged to extend away from said base, each of said walls having a slot, wherein said slots are parallel to said locking surface, and said slots are operatively arranged to slidingly and pivotally attach to at least one of said links by at least one of said pivot means to permit movement of said three bar linkage about at least one of said pivot axis and to permit transverse movement of said three bar linkage parallel to said slots; and, a height indicator fixedly secured to at least one of said links and operatively arranged to indicate a height of said support relative to a height indicating surface, wherein said height indicator moves relative to a rotational axis which is coincident with one of said pivot axis.

25. A mechanism for mounting a support for movement relative to a base, said mechanism having a three bar linkage, said three bar linkage comprising a first link, a second link and a third link, each of said links having a first end and a second end, respectively, said three bar linkage further comprising a first pivot means, a second pivot means and a third pivot means, wherein a first pivot axis, a second pivot axis and a third pivot axis of said first, second and third pivot means, respectively, are parallel to one another, said first end of said first link attached by said first pivot means to said first-end of said second link, said second end of said first link attached by said second pivot means to said third link, said second end of said second link attached by said third pivot means to said third link, said third link operatively arranged to be attached to said support, said mechanism further comprising:

a mounting member operatively arranged to be attached to said base, said mounting member having a locking surface and a pair of parallel spaced apart walls operatively arranged to extend away from said base, each of said walls having a slot, wherein said slots are parallel to said locking surface, and said slots are operatively arranged to slidingly and pivotally attach to at least one of said links by at least one of said pivot means to permit movement of said three bar linkage about at least one of said pivot axis and to permit transverse movement of said three bar linkage parallel to said slots;

a height indicator fixedly secured to at least one of said links and operatively arranged to indicate a height of said support relative to a height indicating surface, wherein said height indicator moves relative to a rotational axis which is coincident with one of said pivot axis; and, an angle indicator fixedly secured to said third link and operatively arranged to indicate the angle of said support relative to an angle indicating surface, wherein said angle indicator moves relative to a rotational axis which is coincident with one of said pivot axis.

26. A mechanism for mounting a support for movement relative to a base, said mechanism having a three bar linkage, said three bar linkage comprising a first link, a second link and a third link, each of said links having a first end and a second end, respectively, said three bar linkage further comprising a first pivot means, a second pivot means and a third pivot means, wherein a first pivot axis, a second pivot axis and a third pivot axis of said first, second and third pivot means, respectively, are parallel to one another, said first end of said first link attached by said first pivot means to said first end of said second link, said second end of said first link attached by said second pivot means to said third link, said second end of said second link attached by said third pivot means to said third link, said third link operatively arranged to be attached to said support, said mechanism further comprising:

a mounting member operatively arranged to be attached to said base, said mounting member having a locking surface and a pair of parallel spaced apart walls operatively arranged to extend away from said base, each of said walls having a slot, wherein said slots are parallel to said locking surface, and said slots are operatively arranged to slidingly and pivotally attach to at least one of said links by at least one of said pivot means to permit movement of said three bar linkage about at least one of said pivot axis and to permit transverse movement of said three bar linkage parallel to said slots;

a height indicator fixedly secured to at least one of said links and operatively arranged to indicate a height of said support relative to a height indicating surface, wherein said height indicator moves relative to a rotational axis which is coincident with one of said pivot axis;

an angle indicator fixedly secured to said third link and operatively arranged to indicate the angle of said support relative to an angle indicating surface, wherein said angle indicator moves relative to a rotational axis which is coincident with one of said pivot axis; and, means for adjusting the angle of said support relative to said angle indicating surface.

27. A mechanism for mounting a support for movement relative to a base, said mechanism having a three bar linkage, said three bar linkage comprising a first link, a second link and a third link, each of said links having a first end and a second end, respectively, said three bar linkage further comprising a first pivot means, a second pivot means and a third pivot means, wherein a first pivot axis, a second pivot axis and a third pivot axis of said first, second and third pivot means, respectively, are parallel to one another, said first end of said first link attached by said first pivot means to said first end of said second link, said second end of said first link attached by said second pivot means to said third link, said second end of said second link attached by said third pivot means to said third link, said third link operatively arranged to be attached to said support, said mechanism further comprising:

a mounting member operatively arranged to be attached to said support, said mounting member having a locking surface and a pair of parallel spaced apart walls operatively arranged to extend away from said support, each of said walls having a slot, wherein said slots are parallel to said locking surface, and said slots are operatively arranged to slidingly and pivotally attach to at least one of said links by at least one of said pivot means to permit movement of said three bar linkage about at least one of said pivot axis and to permit transverse movement of said three bar linkage parallel to said slots.

28. A mechanism for mounting a support for movement relative to a base, said mechanism having a linkage, said linkage comprising at least three links, each of said at least three links having a first end and a second end, respectively, said linkage further comprising at least three pivot means, wherein said at least three links are rotatably attached to each other by said at least three pivot means and at least three pivot axis of said at least three pivot means are parallel to one another, one of said at least three links operatively arranged to be attached to said support, said mechanism further comprising:

a mounting member operatively arranged to be attached to said base, said mounting member having a pair of parallel spaced apart walls operatively arranged to extend away from said base, each of said walls having at least one slot, and said slots are operatively arranged to slidingly and pivotally attach to at least one of said at least three links by at least one of said at least three pivot means to permit movement of said linkage about at least one of said at least three pivot axis and to permit transverse movement of said linkage parallel to said slots.

29. A mechanism for mounting a support for movement relative to a base comprising:

a three bar linkage having a first end adapted for connection to a mounting member, for mounting said support for swinging movement relative to said mounting member between lower and upper positions and for sliding movement with respect to said mounting member between front and back positions and a second end adapted for attachment to said support, said linkage comprising first, second and third links and first, second and third pivot means, wherein first, second and third pivot axes of said first, second and third pivot means, respectively, are parallel, said first link having a first end attached by said first pivot means to said mounting member for pivotal movement about said first pivot axis and for sliding movement with respect to said mounting member and a second end attached by said second pivot means to said third link for pivotal movement about said second pivot axis, said second link having a first end supported on said mounting member by said first pivot means for at least one of pivotal and translational movement about said first pivot axis and for sliding movement with respect to said mounting member and a second end attached by said third pivot means to said third link for pivotal movement about said third pivot axis, and said third link operatively arranged to be attached to said support;

a mounting member operatively arranged to be attached to said base, said mounting member having a locking surface and a pair of parallel spaced apart walls operatively arranged to extend away from said base, each of said walls having a slot, wherein said slots are parallel to said locking surface, and said slots are operatively arranged to slidingly and pivotally attach to at least one of said links by at least one of said pivot means to permit movement of said three bar linkage about at least one of said pivot axis and to permit transverse movement of said three bar linkage parallel to said slots; and, locking means responsive to gravity for retaining said support in a selected vertical position immediate said lower and upper positions and a horizontal position immediate said front and back positions, and responsive to a lifting force applied to said support for releasing said locking means to permit said support to undergo movement towards at least one of said lower, front and back positions.

30. A mechanism for mounting a support for movement relative to a base comprising:

a three bar linkage having a first end adapted for connection to a mounting member, for mounting said support for swinging movement relative to said mounting member between lower and upper positions and for sliding movement with respect to said mounting member between front and back positions and a second end adapted for attachment to said support, said linkage comprising first, second and third links and first, second and third pivot means, wherein first, second and third pivot axes of said first, second and third pivot means, respectively, are parallel, said first link having a first end attached by said first pivot means to said mounting member for pivotal movement about said first pivot axis and for sliding movement with respect to said mounting member and a second end attached by said second pivot means to said third link for pivotal movement about said second pivot axis, said second link having a first end supported on said mounting member by said first pivot means including a single pivot pin means for constraining said second link for at least one of pivotal and translational movement about said first pivot axis and for movement with respect to said mounting member and a second end attached by said third pivot means to said third link for pivotal movement about said third pivot axis, and said third link operatively arranged to be attached to said support;

a mounting member operatively arranged to be attached to said base, said mounting member having a mounting member locking surface and a pair of parallel spaced apart walls operatively arranged to extend away from said base, each of said walls having a slot, wherein said slots are parallel to said locking surface, and said slots are operatively arranged to slidingly and pivotally attach to at least one of said links by at least one of said pivot means to permit movement of said three bar linkage about at least one of said pivot axis and to permit transverse movement of said three bar linkage parallel to said slots; and, said first end of said second link further comprises a bearing surface operatively arranged to bear against said single pivot pin means for at least one of pivotal and translational movement about said first pivot axis and a link locking surface operatively arranged to removably engage with said mounting member locking surface, the force of gravity tending to swing said link locking surface into engagement with said mounting member locking surface about a line of engagement of said bearing surface with said single pivot pin means for releasably retaining said second link against downwardly directed swinging movement about said first pivot axis and sliding movement with respect to said mounting member locking surface, and said link locking surface is removed from locking engagement with said mounting member locking surface to permit downwardly directed swinging movement of said three bar linkage about said first pivot axis and to permit sliding movement of said three bar linkage with respect to said mounting member locking surface by manual application of lifting force to said support.

31. The mechanism for mounting a support for movement relative to a base according to claim 28 wherein said mounting member further comprises a locking surface and said locking surface is parallel to said slots.

* * * * *